US005636620A

United States Patent [19]

Kiess et al.

[11] Patent Number: 5,636,620

[45] Date of Patent: Jun. 10, 1997

[54] SELF DIAGNOSING IGNITION CONTROL

[75] Inventors: Ronald J. Kiess, Decatur; Norman H. Bracken, Anderson, both of Ind.

[73] Assignee: General Motors Corporation, Detroit, Mich.

[21] Appl. No.: 651,320

[22] Filed: May 22, 1996

[51] Int. Cl.[6] ..... F02P 17/00

[52] U.S. Cl. ..... 123/625; 123/630; 123/637; 73/116

[58] Field of Search ..... 123/625, 630, 123/637, 643; 73/116, 117.3; 324/399

[56] References Cited

U.S. PATENT DOCUMENTS

| | | | |
|---|---|---|---|
| 3,626,200 | 12/1971 | Sasayama | 307/106 |
| 3,754,541 | 8/1973 | Sasayama | 123/604 |
| 3,939,811 | 2/1976 | Sasayama | 123/415 |
| 4,100,564 | 7/1978 | Sasayama | 257/570 |
| 4,175,506 | 11/1979 | Sakamoto et al. | 123/416 |
| 5,111,790 | 5/1992 | Grandy | 123/643 |
| 5,237,279 | 8/1993 | Shimasaki et al. | 324/399 |
| 5,431,044 | 7/1995 | Kiess et al. | 73/117.3 |

OTHER PUBLICATIONS

SAE Paper, "Spark Plug Voltage Analysis for Monitoring Combustion in an Internal Combustion Engine", Shimasaki et al Mar. 1–5, 1993.

SAE Paper, "Flame Ion Density Measurement Using Spark Plug Voltage Analysis" Miyata et al Mar. 1–5, 1993.

*Primary Examiner*—Andrew M. Dolinar

*Attorney, Agent, or Firm*—Michael J. Bridges

[57] ABSTRACT

A self-diagnosing ignition drive circuit for applying a first ignition drive signal to a spark plug in an internal combustion engine cylinder for generating an arc across the electrodes thereof to ignite an air/fuel mixture in the cylinder and, following a delay period, applying a second ignition drive signal to the spark plug for generating a second arc across the electrodes to contribute combustion energy and to provide for measurement of the frequency content of energy trapped in an ignition coil during combustion. If the frequency content includes a predetermined frequency, improper ignition in the cylinder is diagnosed through excitation of a natural frequency of a misfire detection circuit coupled to the ignition coil corresponding to at least one engine cylinder.

14 Claims, 6 Drawing Sheets

SELF DIAGNOSING IGNITION CONTROL

FIELD OF THE INVENTION

This invention relates to internal combustion engine control and, more particularly, to ignition control and diagnostic circuitry.

BACKGROUND OF THE INVENTION

An internal combustion engine misfire occurs when an air/fuel mixture is improperly consumed in an engine cylinder. Misfire conditions can affect engine stability and emissions. Misfires must be diagnosed so that treatment procedures may be applied to minimize any resulting effect on stability or emissions. Misdiagnosis of misfire conditions results in unnecessary repair costs and in unnecessary inconvenience to the engine operator.

Several misfire diagnostics have been proposed. Typically, such proposals attempt to identify engine speed variation patterns characteristic of engine misfire conditions. Such characteristic misfire patterns can be difficult to identify at certain engine operating levels such that the diagnostic may be disabled at such operating levels or may be prone to misdiagnosis at such operating levels.

It would therefore be desirable to reliably diagnose engine cylinder misfire conditions at all engine operating levels.

SUMMARY OF THE INVENTION

The present invention provide for accurate internal combustion engine misfire diagnosis at all engine operating levels through integrated ignition control and diagnostic circuitry.

More specifically, in an internal combustion engine ignition system in which an ignition coil provides a drive signal to a spark plug in an engine cylinder to ignite an air/fuel mixture in the cylinder, the ignition coil acts as a filter which traps a specific band of energy. It has been determined that the frequency of this trapped energy shifts significantly if combustion is present in the plasma to which the spark plug receiving the ignition coil drive signal is exposed in the engine cylinder. The present invention provides an ignition system which provides an ignition coil drive signal for initiating combustion in an engine cylinder, followed by a measurement signal. The measurement signal allows for monitoring of the frequency of the band of energy trapped by the ignition coil. A significant shift in the frequency away from a known frequency indicates combustion in the cylinder and no misfire. An insignificant shift in frequency away from the known frequency indicates a misfire condition which may then be recorded or indicated so that remedial action may be taken.

In accord with a further aspect of this invention, the ignition system drive and measurement signals appear as two sequential ignition pulses applied to an ignition drive circuit. The drive pulse is applied first to cause a spark across the electrodes of a spark plug for combustion of an air/fuel mixture in an engine cylinder. Time-shifted from the drive pulse is the second pulse, called the measurement pulse, which creates a second spark across the spark plug electrodes at a time after the drive pulse, at which time combustion should be present in the engine cylinder. If combustion is present, the frequency band of energy trapped in the ignition coil at the time of the measurement pulse will be significantly shifted, indicating a normal combustion condition and no misfire. Otherwise, a misfire is reliably detected over a range of engine speeds.

In accord with yet a further aspect of this invention, a frequency within the described frequency band is identified and a misfire detection circuit which is coupled to the ignition coil includes a network having a natural frequency tuned to the identified frequency such that, if the frequency is present in the ignition coil it will be passed from the ignition coil to the misfire detection circuit exciting the natural frequency of the network which will significantly elevate an output signal of the misfire detection circuit. The output signal is applied to comparison circuitry for determining when such elevation occurs to indicate a misfire condition. If the identified frequency is shifted and therefore is not present in the ignition coil, network excitation will not occur and no misfire condition will be indicated.

In accord with yet a further aspect of this invention, the time shift between the drive and measurement pulses is varied as a function of an engine operating parameter to ensure that the measurement pulse occurs at a time following the drive pulse at which combustion should normally be present in the engine cylinder, to contribute to reliable misfire diagnosis at all engine operating conditions. In accord with yet a further aspect of this invention, the engine operating parameter is engine speed.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
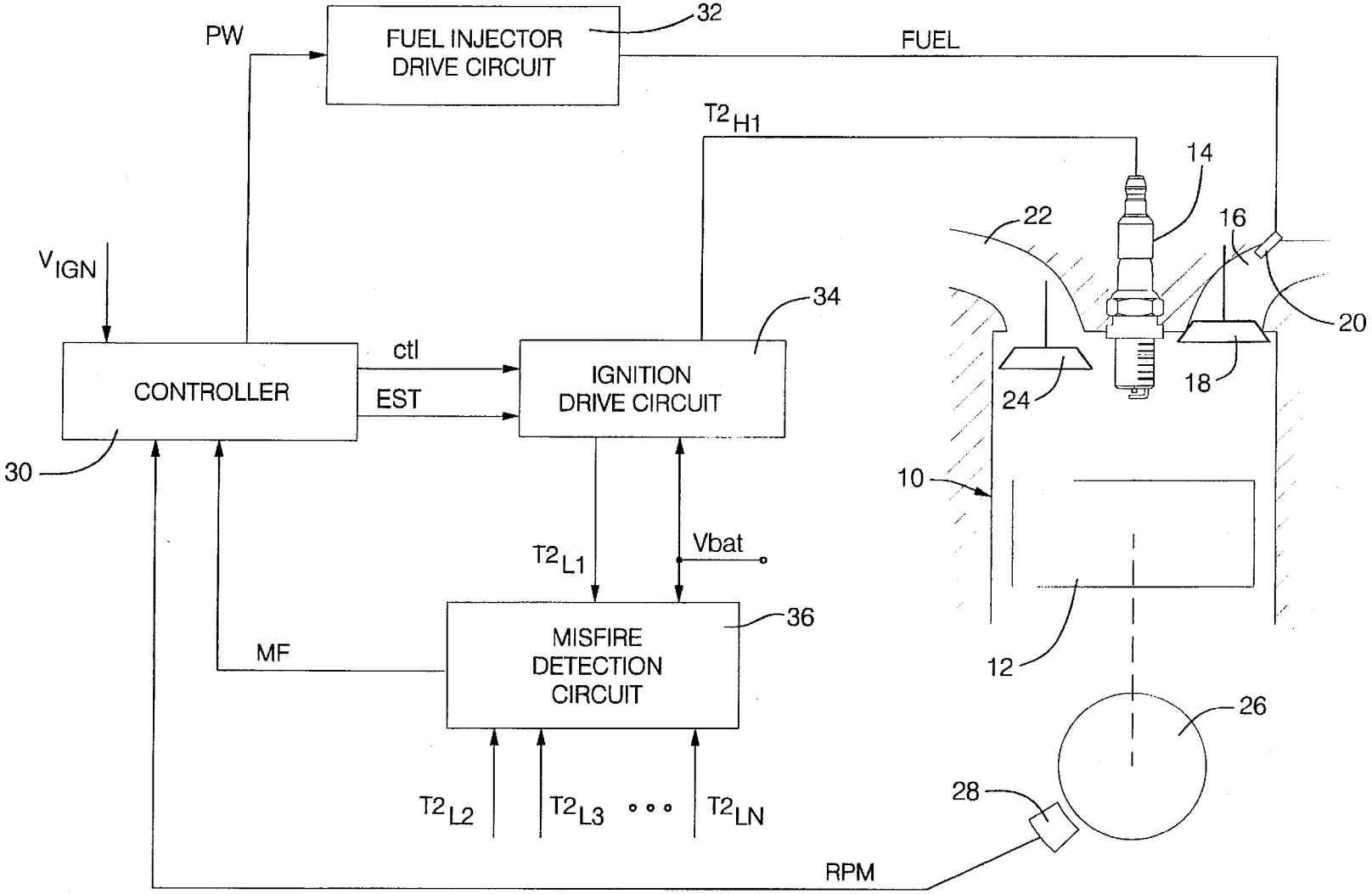
FIG. 1 is a general diagram of engine control and diagnostic hardware applied to an internal combustion engine in accord with the preferred embodiment.

Referring to FIG. 1, an individual cylinder 10 of a multiple cylinder internal combustion engine having N such cylinders is illustrated. Piston 12 is disposed within the cylinder 10 and is mechanically linked through a connecting rod (not shown) to crankshaft 26 which rotates as the piston 12 reciprocates within the cylinder 10. A plurality of spaced teeth or notches (not shown) are disposed about the crankshaft and pass by variable reluctance or Hall effect sensor 28 which transduces passage of the teeth or notches into cycles of an analog output signal RPM the frequency of which is proportional to the rate of rotation of the crankshaft (engine speed) and individual cycles of which indicate occurrence of engine cylinder events. Fuel is injected into intake runner 16 by fuel injector 20 and is nixed with an intake air charge. The air/fuel mixture is drawn into the cylinder 10 while intake valve is open during an intake stroke of the piston 12 within the cylinder 10. The intake stroke is followed by a compression stroke after which spark plug drive signal $T2_{H1}$ is applied to spark plug 14 causing an arc across the electrodes thereof (termed a combustion arc in this embodiment) for igniting the air/fuel mixture in the cylinder 10. A second arc across the electrodes of spark plug 14 (termed a measurement arc in this embodiment) follows the combustion arc by a short period of time, such as about 0.5–1.0 milliseconds in this embodiment for misfire detection in accord with this invention. The measurement arc allows for determination of the frequency of a band of energy trapped in the ignition coil (or winding) indicating whether combustion is present in the ionized gas in the engine cylinder 10, as will be further described. The frequency of trapped energy appears on ignition drive circuit output $T2_{L1}$ which is provided to a misfire detection circuit 36, as will be further described in FIG. 2 for the preferred embodiment. The misfire detection circuit identifies when a shift in frequency indicating proper combustion in the cylinder is present following the combustion arc. If no such shift is present following the combustion arc, signal MF is driven to an active state, such as to a logic "one" level indicating a detected misfire condition in cylinder 10. The misfire detection circuit further may receive signals $T2_{L2}$, $T2_{L3}$, . . . , $T2_{LN}$ indicating the frequency of trapped energy in the ignition winding provided for combustion in the other of the N engine cylinders (not shown). Each of such other cylinders may have associated with it an ignition drive circuit of the construction of circuit 34, to be more fully described in FIG. 2, and as detailed in copending U.S. patent application Ser. No. 08/651,416, filed on the filing date of this application, attorney docket no. H-197300, assigned to the assignee of this application, for providing a spark plug drive signal to a spark plug for its corresponding cylinder. Each such ignition drive circuit also provides output signal $T2_{Lk}$ indicating the described frequency shift information to misfire detection circuit, wherein output signal MF of the misfire detection circuit provides information on misfire conditions in all of the N cylinders of the engine. The signal MF, as well as signal RPM and other signals indicating engine parameter values are applied to controller 30 which takes the form of a conventional microprocessor-based vehicle controller including such conventional controller elements as a central processing unit with arithmetic logic circuitry and control circuitry, read only memory circuitry, random access memory circuitry, and input/output circuitry. The controller 30 may log information on detected individual cylinder misfires, and take any conventional diagnostic action, such as illuminating indicators, energizing alarms, storing fault condition codes in non-volatile memory locations, etc. Additionally, the controller 30 carries out such control activities as generating and outputting fuel injector pulse width signal PW to fuel injector drive circuit 32 for timed application to individual cylinder fuel injectors, such as injector 20 of cylinder 10. The injector drive circuit transforms signal PW into a drive signal that provides for a pulse of fuel to be injected through the active fuel injector into the corresponding intake runner. The duration of the injection pulse corresponds to the width of pulse PW. The controller 30 also issues signal EST indicating a desired timing of ignition of an active spark plug to the ignition drive circuit 34. The ignition drive circuit 34, to be described in FIG. 2, transforms the signal EST into a drive signal providing for a timed combustion arc followed by the measurement arc across spark plug electrodes. The controller still further issues control signal ctl to ignition drive circuit 34 for controlling the time duration between the combustion and measurement arcs as a function of engine speed. In this embodiment, the signal ctl is set to a signal level corresponding to approximately 1.0 milliseconds between the arcs for engine speeds up to 4000 r.p.m., and to a signal level corresponding to approximately 0.5 milliseconds between arcs for engine speeds above 4000 r.p.m. The controller 30 is activated to carry out control and diagnostic procedures through application of vehicle ignition power Vign thereto. The ignition drive circuit 34 and the misfire detection circuit 36 are electrically driven by a system power source, such as voltage Vbat from a vehicle battery (not shown).

Figure 2:
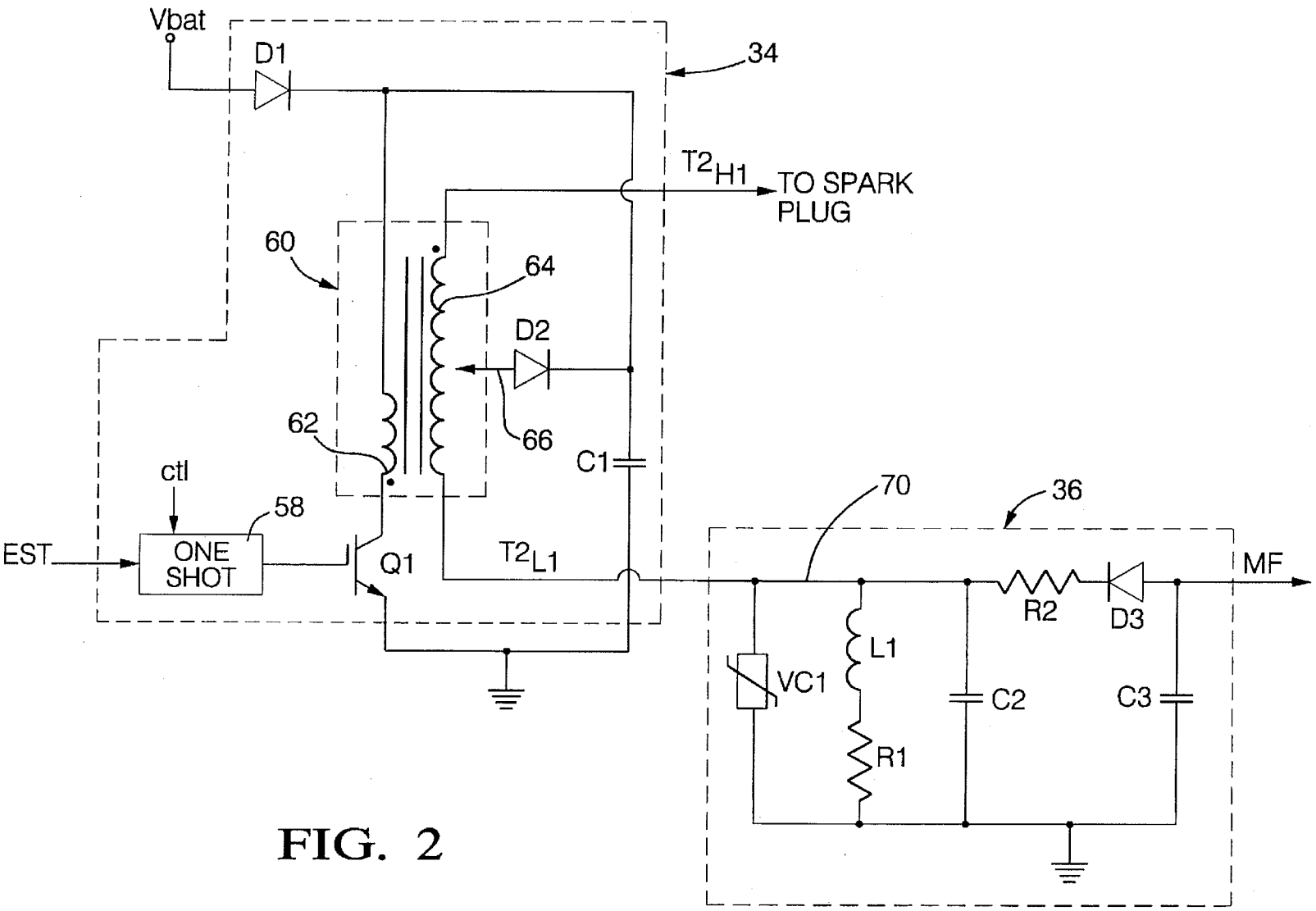
FIG. 2 is a schematic diagram of the ignition control circuit and misfire detection circuit of FIG. 1.
Figures 3A, 3B, 3C, 3D:
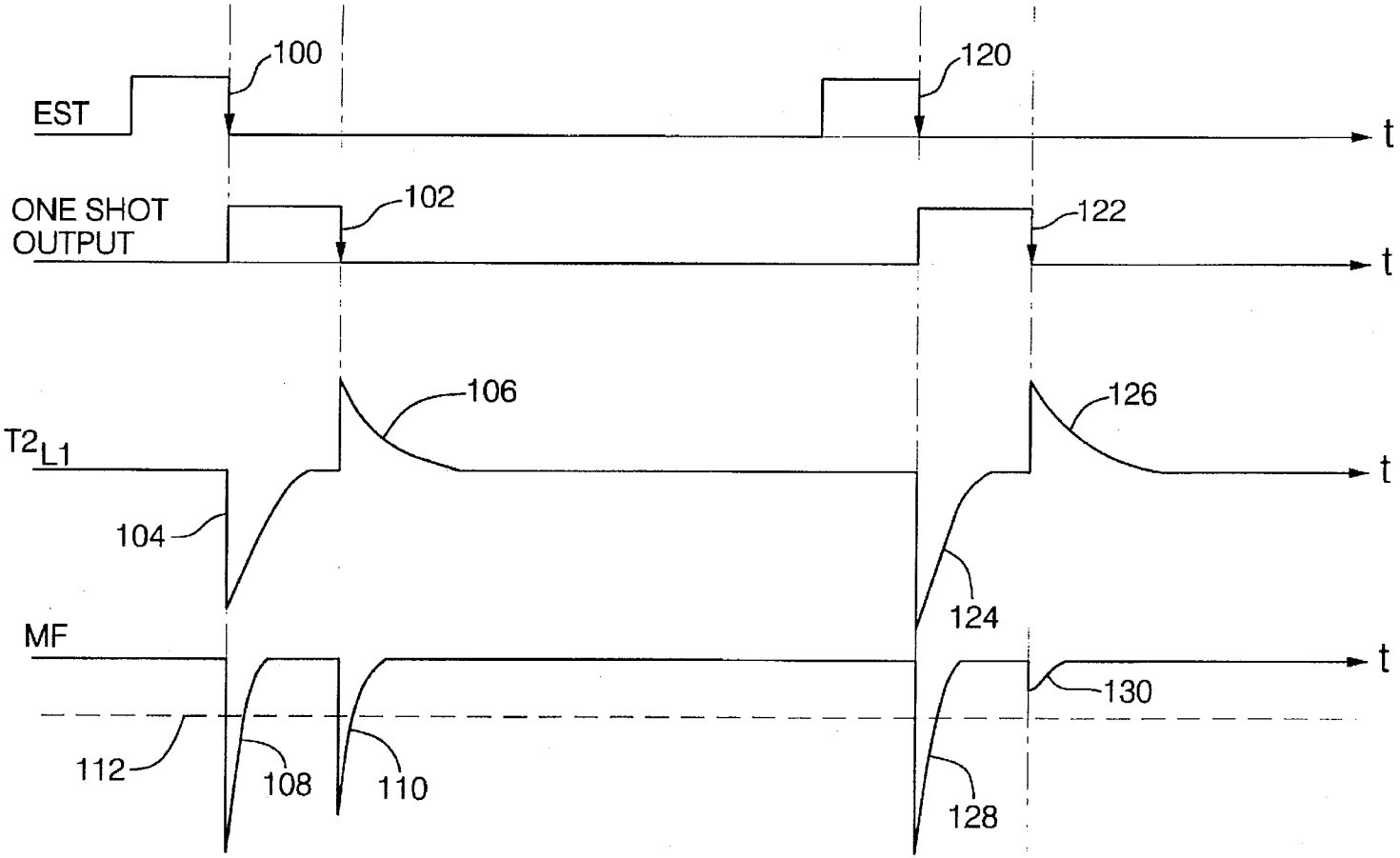
FIGS. 3*a*–3*d* are signal timing diagrams illustrating a temporal relationship between ignition drive and diagnostic signals of the circuits of FIG. 2.

Referring to FIG. 2, a preferred implementation of the ignition drive circuit 34 coupled to the misfire detection circuit 36 of FIG. 1 is illustrated. Signal EST is passed to the ignition drive circuit 34 and to one-shot 58 which is configured to be active on the falling edge of EST and which, when active, outputs a positive voltage pulse of duration set in accord with control signal ctl, which may be output by controller 30 of FIG. 1. The one-shot output is applied to the base of conventional transistor Q1 of the integrated gate bipolar type. The one-shot may be implemented in any conventional manner including through well-known 555 timer hardware implementations. The emitter of transistor Q1 is tied to a ground reference and the collector to a low side of the primary winding 62 of conventional step-up transformer 60 having approximately a 1:100 winding ratio and an inverse winding polarity. The high side of the primary winding 62 (opposing the low side thereof) is tied to battery voltage Vbat through diode D1 and is electrically tied to a high side of capacitor C1 of about two microFarads. The low side of C1 is connected to the ground reference. An electrical tap 66 is provided along the secondary winding (or coil) 64 to anode of diode D2, the cathode of D2 being tied to the high side of capacitor C1. The high side of secondary winding 64 provides output spark plug drive signal $T2_{H1}$ to the terminal of spark plug 14 of FIG. 1 and the low side of the secondary winding 64 (opposing the high side thereof) is provided as output signal $T2_{L1}$ to the misfire detection circuit 36.

The misfire detection circuit 36 comprises voltage clamp VC1 which may be implemented as a back-to-back Zener diode pair or as a metal oxide varistor (MOV) which operates to limit the maximum voltage between an upper circuit node 70 and the ground reference. In parallel with VC1 are the following:

(a) series inductor-resistor pair of inductor L1 of about 220 microHenrys and resistor R1 of about sixty-two ohms, (b) capacitor C2 of about 6800 picoFarads, and (c) series combination of resistor R2 of about 1 kilohm, diode D3, and capacitor C3 of about 1500 picoFarads. The misfire detection circuit output signal MF is taken from the connection node between the anode of D3 and C3.

Functionally, transistor Q1 is turned on with the rising edge of the output signal of one shot 58 which occurs at the falling edge of signal EST. When Q1 turns on, the capacitor C1, which has previously been charged up to between 250–400 volts, is rapidly discharged through the primary winding 62 of the transformer 60 inducing a surge of current of negative polarity (due to the inverse winding polarity of the transformer 60) through the secondary winding 64 of the transformer which passes as signal $T2_{H1}$ to the spark plug terminal and across the electrodes thereof providing a combustion arc across the electrodes to ignite the air/fuel mixture in the engine cylinder 10. The voltage on C1 also operates to reverse bias diode D1 to prevent current flow from the vehicle battery. As the capacitor C1 rapidly discharges through the primary winding 62 of transformer 60, the diode D1 switches to a forward biased state, allowing current from the vehicle battery to flow through the primary winding 62. Current from the battery ramps up in the primary winding 62 until the output pulse from the one shot 58 falls at the time of the desired issuance of the measurement arc, turning off transistor Q1, which produces a flyback pulse of positive polarity at the low side of the primary winding 62. The step-up transformer 60 transforms this flyback pulse into a higher magnitude pulse through the secondary winding 64 and to the terminal of the spark plug 14 (FIG. 1) and across the electrodes thereof producing measurement arc in the engine cylinder 10 about 0.5–1.0 milliseconds after the combustion arc, for measuring the frequency of the energy trapped in the secondary winding as an indication of whether combustion is present in the cylinder 10. The secondary winding of transformer 60 is referenced to ground through the inductor-resistor pair (L1 and R1) of the misfire detection circuit 36. During the flyback pulse, a portion of the current in the secondary winding 64 is tapped via tap 66 through diode D2 to recharge capacitor C1. Prior to occurrence of the flyback pulse, diode D2 is reverse biased, preventing such recharging of C1. Diode D3 of the misfire detection circuit 36 rectifies the RF voltage of the L-R-C network formed with C2 in parallel connection with the series connection of L1 and R1. Resistor R1 lowers the quality factor of inductor L1 reducing ringing (improving the signal discrimination ratio) of the L-R-C network. Capacitor C3 provides for signal filtering to improve signal processing, and resistor R2 operates to decouple diode D3 from the L-R-C network formed between L1, R1, and C2.

A significant RF voltage is developed across the electrodes of spark plug 14 during ignition events of the spark plug. While combustion is present in the plasma in the area of the spark plug electrodes, there are relatively narrow frequency bands within the plasma that are trapped or absorbed in the winding of transformer 60. By providing the measurement arc across the spark plug electrodes shortly after the combustion arc when combustion of the air/fuel mixture should be present in the cylinder 10 in the absence of a misfire condition, a determination can be made of whether those frequency bands are absent, indicating combustion. By properly selecting values for L1 and C2 of the L-R-C network, the natural frequency of the L-R-C network can be tuned to one of those relatively narrow frequency bands. Accordingly, if combustion is not present in the plasma within the cylinder (such as cylinder 10 of FIG. 1) during occurrence of the measurement arc, the relatively narrow frequency bands will be present, exciting the natural frequency of the L-R-C network, causing a high voltage spike in the misfire detection circuit output signal MF. Alternatively, if combustion is present during occurrence of the measurement arc across the electrodes, the narrow frequency bands will be absent and no excitation will occur providing for a misfire detection circuit output signal MF of relatively low voltage amplitude.

FIGS. 3*a*–3*d* illustrate the signals for an operating condition in which a misfire condition is present and an operating condition in which a misfire condition is not present in engine cylinder 10 of FIG. 1. Specifically, signal pulses 100–110 illustrate a flow of signals through the circuitry of FIG. 2 when a misfire condition is present in cylinder 10 and signal pulses 120–128 illustrate a flow of signals through the circuitry of FIG. 2 when a misfire condition is not present in cylinder 10. On the falling edge of EST signal 100, the one shot output 102 is driven high, and negative polarity combustion arc is provided in the engine cylinder 10, with negative pulse $T2_{L1}$ 104 passing to the misfire detection circuit. The RF components appear in the plasma within cylinder 10 including those frequency components corresponding to the natural frequency of the R-L-C network of the misfire detection circuit 36 (FIG. 2), whereby the natural frequency of the R-L-C network is excited as signal $T2_{L1}$ passes to the circuit, causing a significant misfire detection circuit output signal amplitude 108. This output signal will appear for each combustion arc across the spark plug electrodes and may be used by controller as a "marker pulse" indicating a combustion event has occurred in the cylinder 10. Following such marker pulse, the controller 30 of FIG. 1 is set up to monitor output signal MF for a second pulse of significant magnitude, such as magnitude exceeding a predetermined threshold amplitude, illustrated in FIG. 3 as reference line 112. The falling edge of the one shot output 102 provides for such second pulse in the event combustion is absent in the engine cylinder 10 shortly after the combustion arc. Specifically, the flyback pulse 106 of signal $T2_{L1}$ is generated in the ignition drive circuit 34 of FIG. 2 as described at the falling edge of the one shot output signal and is passed to the misfire detection circuit 36 of FIG. 2. Presence of RF frequency components in the signal $T2_{L1}$ indicate an absence of combustion in the cylinder 10 leading to excitation of the natural frequency of the misfire detection circuit 36 of FIG. 2 and a significant output signal MF amplitude illustrated for a misfire condition as signal 110 exceeding the reference amplitude 112. The controller 30 of FIG. 1 distinguishes the amplitude of MF and provides for storage of data indicating the condition including the responsible cylinder and further may provide for indication of the condition to an operator.

In the event a misfire condition is not present in the cylinder 10, the falling edge of signal EST 120 will still generate a rising edge of the one shot output 122, leading to a negative polarity signal $T2_{L1}$ 124 which is passed to misfire detection circuit 36 of FIG. 2 and excites the natural frequency thereof providing for marker pulse 128 in the MF output signal passed to controller 30 of FIG. 1. The falling edge of the one shot output 122 occurs between 0.5–1.0 milliseconds after the rising edge thereof and initiates flyback pulse 126 which is passed to misfire detection circuit. The absorption of certain RF frequency bands occurs due to the presence of combustion in the plasma in the cylinder 10 as described and not excitation of the natural frequency of the R-L-C network of the misfire detection circuit 36 of FIG. 2 occurs, resulting in a relatively low amplitude output signal pulse 130 on output signal MF, which does not exceeds the threshold 112, and no misfire condition is diagnosed.

Figure 4:
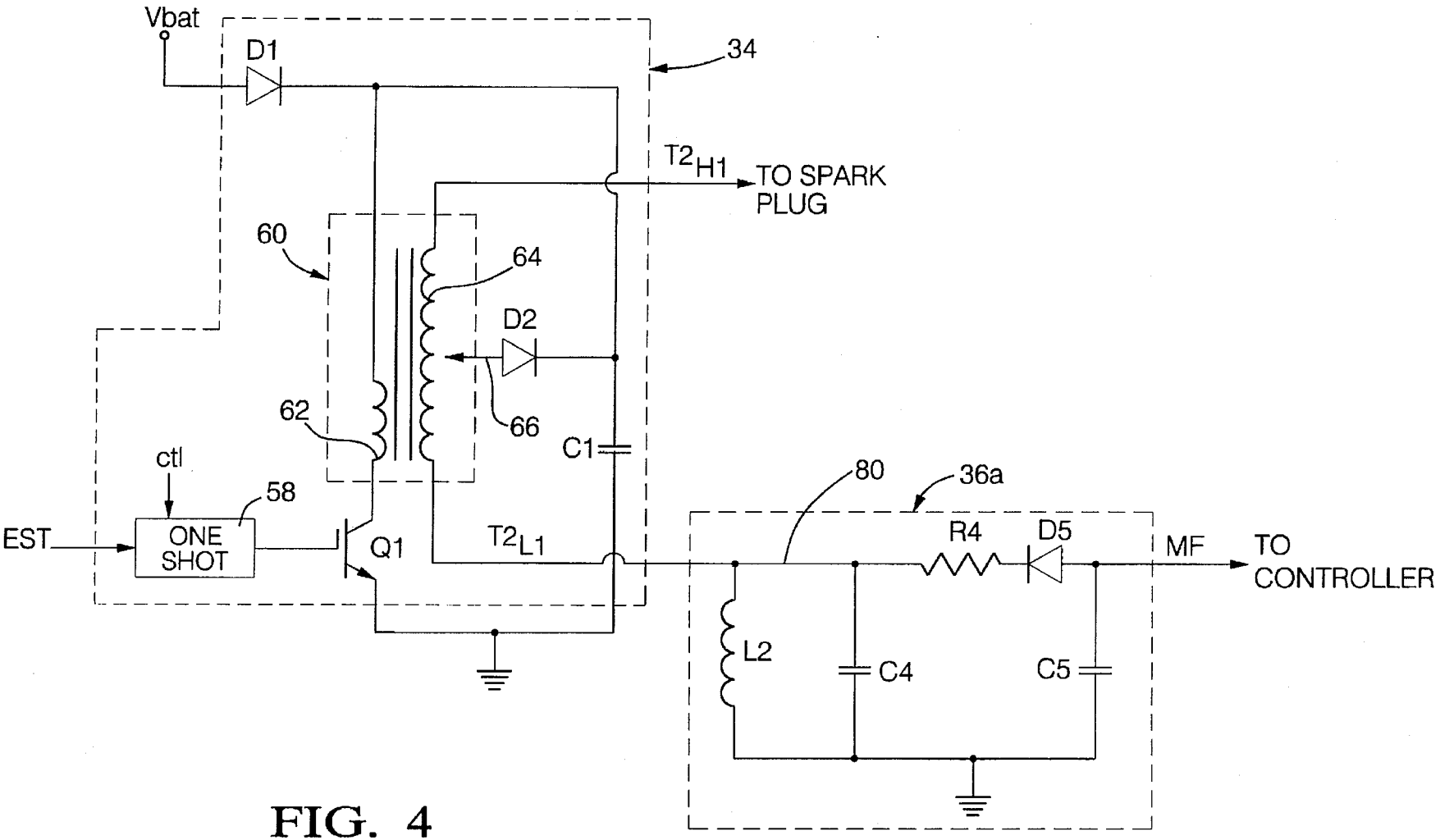
FIG. 4 is a schematic diagram of the ignition control circuit of FIG. 1 with an alternative misfire detection circuit within the scope of this invention.

Referring to FIG. 4, an alternative misfire detection circuit implementation 36*a* is provided with the ignition drive circuit 34 of the preferred embodiment providing an alternative approach for distinguishing whether specific RF frequencies have been absorbed in the windings of transformer 60 of FIG. 4 due to combustion presence in the plasma within engine cylinder 10 of FIG. 1. As described in FIG. 2, signal EST is passed to the ignition drive circuit 34 and to one-shot 58 which is configured to be active on the falling edge of EST and which, when active, outputs a positive voltage pulse of duration set in accord with control signal ctl, which may be output by controller 30 of FIG. 1. The one-shot output is applied to the base of transistor Q1. The one-shot may be implemented as described in FIG. 2. The emitter of transistor Q1 is tied to a ground reference and the collector to a low side of the primary winding 62 of conventional transformer 60 having an inverse winding polarity. The high side of the primary winding 62 is tied to battery voltage Vbat through diode D1 and is electrically tied to a high side of capacitor C1 of about two microFarads. The low side of C1 is connected to the ground reference. An electrical tap 66 is provided along the secondary winding 64 to anode of diode D2, the cathode of D2 being tied to the high side of capacitor C1. The high side of secondary winding 64 provides output spark plug drive signal $T2_{H1}$ to the terminal of spark plug 14 of FIG. 1 and the low side of the secondary terminal 64 is provided as output signal $T2_{L1}$ to the misfire detection circuit 36. The misfire detection circuit 36*a* of FIG. 4 comprises L-C network including a parallel configuration of inductor L2 of about 220 microHenrys and capacitor C4 of about 6200 picoFarads in this embodiment between the input node 80 and a ground reference. In series with the L-C network is a series combination of resistor R4 of about one kilohm, diode D5 and capacitor C5 of about 1500 picoFarads. The output signal MF is picked off the circuit between the anode of D5 and C5.

Functionally, the ignition drive circuit of FIG. 4 is identical to that of FIG. 2. Turning to the misfire detection circuit 36*a*, the values of L2 and C4 may be selected to provide for a natural frequency of the L-C network formed thereby corresponding to a frequency absorbed by the windings of transformer 60 when combustion is present in the plasma within cylinder 10, as described for the L-K-C network of FIG. 2. Diode D5 rectifies the L-C network voltage, resistor R4 decouples diode D5 from the L-C network, and capacitor C5 filters the misfire detection circuit output signal MF to improve signal processing. The signals illustrated in FIGS. 3*a*–3*d* describe the flow of signals through the circuits of FIG. 4 for a misfire condition and in the absence of a misfire condition in the manner described for the circuits of FIG. 2.

Figure 5:
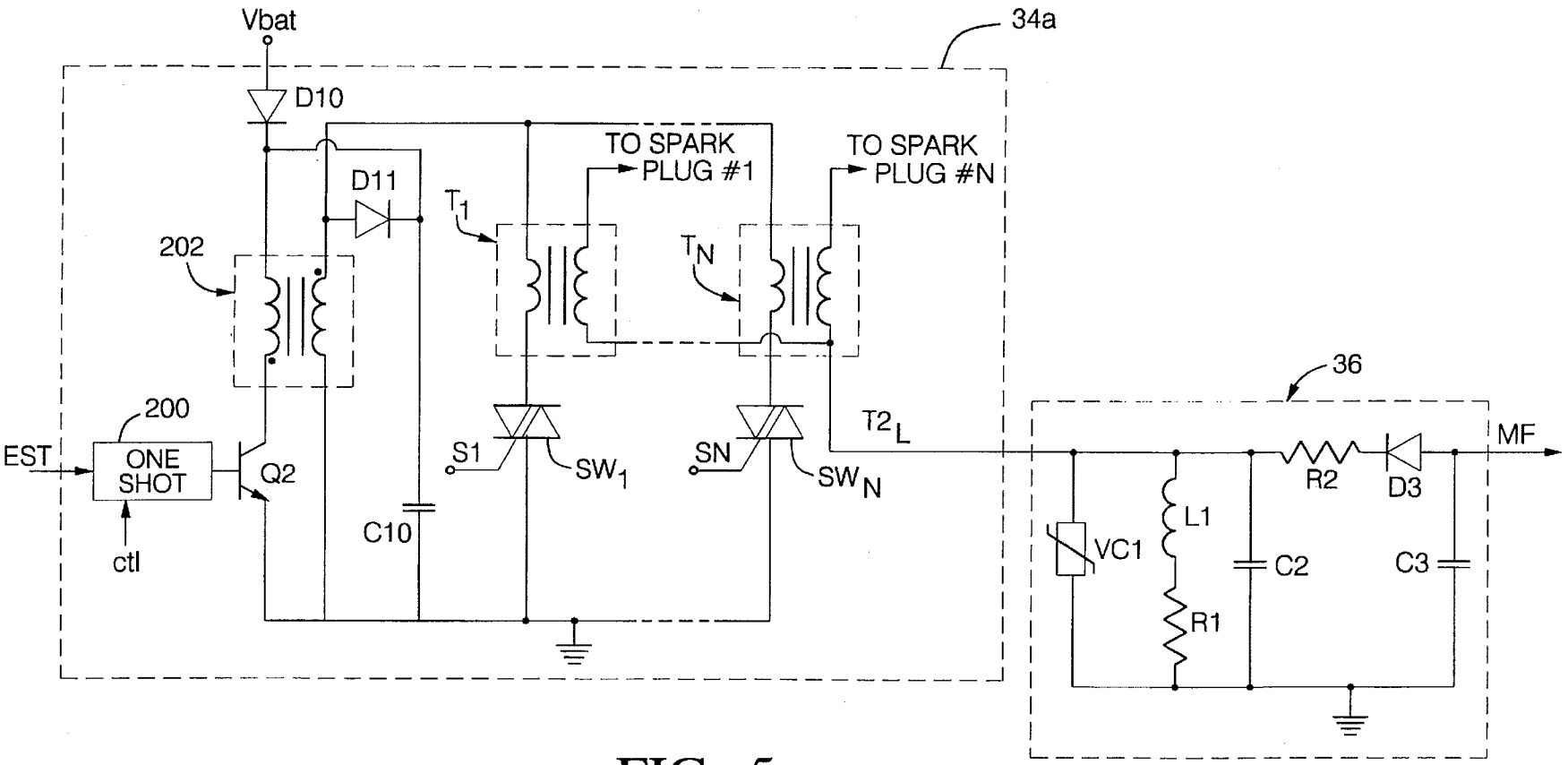
FIGS. 5 and 6 are schematic diagrams of first and second alternative combinations of ignition drive circuitry with the misfire detection circuitry of FIG. 1.

Referring to FIG. 5, an alternative dual pulse ignition drive circuit 34*a* is illustrated in accord with an alternative embodiment of this invention in which a spark plug (not shown) of each of N engine cylinders is driven by the ignition drive circuit 34*a* and in which misfire conditions of any of the N engine cylinders are diagnosed by misfire detection circuit 36. Each cylinder has corresponding ignition drive circuitry in the circuit 34*a* including, for a cylinder K of the N engine cylinders, a conventional step-up transformer $T_K$ controlled by a semiconductor switch $SW_K$ coupled to the low side of the primary winding of the corresponding transformer $T_K$. The switches $SW_1$ through $SW_N$ may be implemented as commercially-available bi-directional thyristors (TRIACs) and are driven by respective digital signals S1 through SN issued by a digital controller (such as controller 30 of FIG. 1). The signals S1 through SN are normally low, and are set high for a cylinder when that cylinder is to undergo an ignition event, to switch the corresponding triac to a conductive state. The rising edge of each signal S1 through SN occurs when the corresponding cylinder is active on the falling edge of the current EST signal issued by controller as is generally understood in the art and the falling edge of each signal S1 through SN follows the rising edge by between 0.5–1.0 milliseconds, depending on engine speed. Specifically, in this embodiment is engine speed is below 4000 r.p.m. ,as indicated by signal RPM of FIG. 1, the signals S1 through SN will have a pulsewidth of about 1.0 milliseconds, and will otherwise have a pulsewidth of bout 0.5 milliseconds.

Spark timing signal EST is applied through a conventional one shot 200, implemented in the manner described for the one shot of FIG. 2 such that on the falling edge of EST, the one shot output is driven to a high state for a period of time dictated by control input ctl. ctl may be set to provide for a one shot pulse width of between 0.5 and 1.0 milliseconds depending on engine speed, as indicated by signal RPM of FIG. 1 and as described for the one shot of FIG. 2. The one shot 200 output is applied to the base of integrated gate bipolar transistor IGBT Q2 with the collector of Q2 coupled to the low side of the primary winding of transformer 202. The emitter of Q2 is tied to a ground reference. The high side of the transformer 202 primary winding is coupled to the cathode of diode D10, the anode of which is coupled to Vbat. The cathode of D10 is further coupled to a high voltage side of capacitor C10 of about two microFarads, the opposing low side of which is tied to a ground reference. Cathode of diode D11 is coupled to the high side of C10 and anode of D11 is coupled to the high side of the secondary winding of transformer 202. The low side of the secondary winding of transformer 202 is coupled to the ground reference. The high side of the secondary winding of transformer 202 is coupled to the primary winding of each of N transformers $T_1$ through $T_N$, with the low side of the primary winding coupled to the corresponding triac $SW_1$through $SW_N$. Each triac $SW_1$ through $SW_N$ is coupled to the ground reference providing for a grounding of the low side of the primary winding of its corresponding transformer when the control input to the switch ($S_1$ though $S_N$) is set to a high state.

Functionally, when the falling edge of signal EST is applied to one shot 200, the one shot output is driven to a high state, turning Q2 on, allowing charged up capacitor C10 to discharge through the primary winding of reverse polarity transformer 202 having about a 1:1 winding ratio. A negative high voltage pulse is thereby induced in the secondary winding of transformer 202 and passes to the active (Kth) transformer (from transformers $T_1$ through $T_N$) corresponding to a conductive triac $SW_K$. The transformers $T_1$ through $T_N$ are step up transformers of about a 1:100 winding ratio. The high voltage pulse induced in the secondary winding of the active transformer $T_K$ drives a surge of current through the corresponding spark plug and across the electrodes thereof, providing a combustion arc in the Kth engine cylinder. The high d.c. voltage on the high voltage side of capacitor C10 is applied to the cathode of diode D10 preventing current flow from Vbat sourced from the battery (not shown). C10 is rapidly discharged through the primary winding of transformer 202, providing that D10 is soon forward biased, allowing battery current to flow through the primary winding of transformer 202. Battery current ramps up in the primary winding of transformer 202 until the output of one shot drops low, which turns off Q2 producing a flyback pulse of positive polarity at the end of the primary winding of transformer 202 coupled to the collector of Q2. This flyback pulse is transformed into a higher magnitude positive pulse through the secondary winding of the transformer 202 and output to the primary winding of the transformer $T_K$ having an active (conductive) triac $SW_K$, inducing a surge of current trough the secondary winding of $T_K$ applied to the corresponding (Kth) spark plug terminal and across the electrodes thereof, producing a measurement arc thereacross. As described for the secondary winding 64 of the transformer 60 of FIG. 2, the flyback pulse is provided as an output pulse $T2_L$ to the misfire detection circuit 36 which is configured and operates as described for the circuit 36 of FIG. 2. The secondary winding of each of the transformers T1 through TN is referenced to the ground reference through the L-R input of the misfire detection circuit 36. During the flyback pulse, a portion of the current passing the through the secondary winding of transformer 202 is tapped off by diode D11 to recharge capacitor C10. During the first pulse, D11 is reverse biased. The predetermined natural frequency of the L-R-C network is excited by frequency components in the signal $T2_L$ providing a misfire detection circuit output signal MF of high amplitude which is passed to controller 30 of FIG. 1 for comparison with a predetermined threshold. The comparison may, in any of the described embodiments of this invention, be carried out using op-amp based comparator circuitry external to the controller 30 of FIG. 1 or may be implemented in the controller 30, for example by passing MF signal through a conventional analog to digital converter device to generate a digital representation of the amplitude thereof, and comparing that digital representation to a digital representation of the threshold amplitude. In the event MF is of negative polarity, the analog to digital converter must have negative range or the polarity of the signal MF must be inverted prior to application to the comparator or to the converter, such as is generally understood in the art. Returning to the misfire detection circuit, in the event frequency components of the signal $T2_L$ do not match the natural frequency of the R-L-C network of the misfire detection circuit 36, the amplitude of the circuit output signal MF will not exceed the threshold amplitude and no misfire condition will be diagnosed.

Accordingly, the circuits of FIG. 5 provide for repeated combustion arcs across the electrodes of spark plugs in N engine cylinders each arc of which is followed by a measurement arc. The misfire detection circuit 36 diagnoses misfire conditions in N engine cylinders and indicates such conditions as high amplitude pulses on the output signal MF following the pulse corresponding to each combustion arc (previously described as the marker pulse). The signal diagrams of FIGS. 3*a*–3*d* illustrate the signals of FIG. 5 for one of the N engine cylinders in both a misfire condition and in a condition in which no misfire is present.

Figure 6:
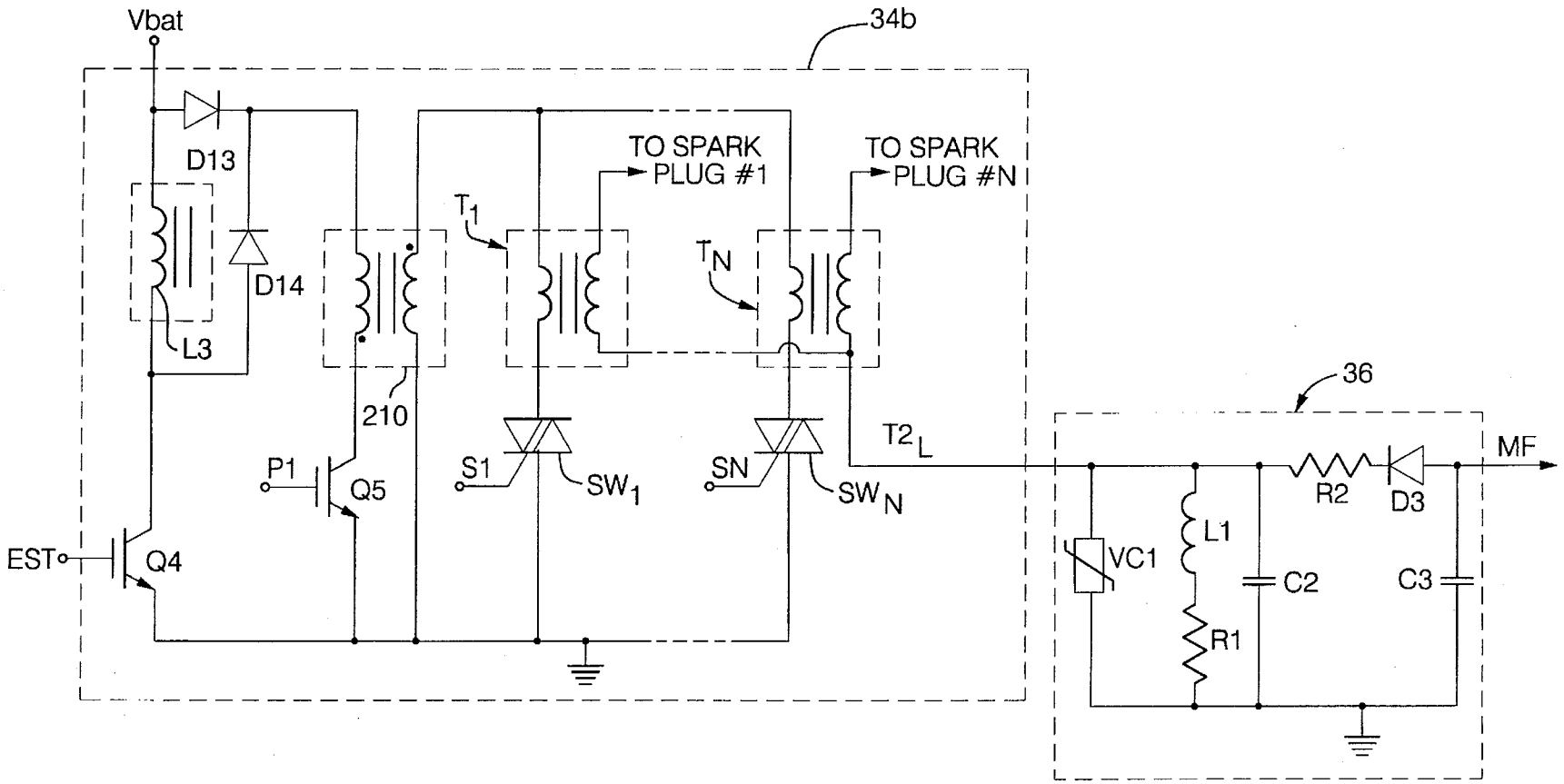

Referring to FIG. 6, an alternative embodiment of the ignition drive circuit 34*b* is illustrated coupled to the misfire detection circuit 36 of FIG. 2. The ignition drive circuit 34*b* is provided for driving spark plugs of each of N engine cylinders to deliver a combustion arc across the electrodes thereof followed by a measurement arc. The ignition drive circuit 34*b* shares many components with the described ignition drive circuit 34*a* of FIG. 5, including N step up transformers $T_1$ through $T_N$ each having coupled to the low side of the primary winding thereof a semiconductor bi-directional switch $SW_1$ through $SW_N$ normally in an open circuit state and driven to a closed circuit (conductive) state by a logic one pulse on a normally low, controller 30 issued, timed control signal $S_1$ through $S_N$, respectively. The low side of the secondary winding of each of the N transformers are coupled together and passed as signal $T2_L$ to the misfire detection circuit 36 as described in FIG. 5. driven to a conductive state. Each of the switches $SW_1$ through $SW_N$ are coupled to the ground reference for "grounding" the low side of the primary winding of the corresponding transformer when the switch is in a closed circuit state.

The circuit of FIG. 6 provides, for driving each of the N transformers $T_1$ through $T_N$, transistor Q4 of the integrated gate bipolar type having a base coupled to the controller 30 issued signal EST, a collector coupled to the low side of storage inductor L2 of between one and eight milliHenrys and the emitter coupled to the ground reference. The high side of L2 (opposing the low side thereof) is coupled to a battery voltage source Vbat which is also coupled to the anode of diode D13. The cathode of D13 is coupled to the cathode of diode D14, with the anode of D14 tied to the low side of L2. The high side of the primary winding of conventional transformer 210 is tied to the node between the cathodes of D13 and D14. The low side of the primary of transformer 210 (opposing the high side thereof) is coupled to the collector of transistor Q5 of the integrated gate bipolar type, with the emitter of Q5 tied to the ground reference. Applied to the base of Q5 is signal P1, which is a control pulse generated by logic "OR'ing" signals S1 through SN and signal EST together, wherein the timing of S1 through SN is controlled so they are of between 0.5 and 1.0 milliseconds in duration as determined as a function of engine speed, as described for signal ctl for controlling the one shot of FIG. 2. Generally, signal P1 is a control signal having a rising edge at each rising edge of signal EST and a falling edge following each rising edge at each falling edge of any active signal S1 through SN. S1 through SN are generated as described in FIG. 5.

The low side of the secondary winding of transformer 210 is coupled to the ground reference and the high side of the secondary winding of transformer 210 is coupled to the high side of the primary windings of transformers $T_1$ through $T_N$. Functionally, Q4 is turned on when signal EST is driven by controller 30 of FIG. 1 to a high state and Q5 is turned on at the same time by P1 being driven to a high state, as described. Current ramps up in the storage inductor L2 until the falling edge of EST is applied to the base of Q4, turning Q4 off. The interruption of current in L2 induces a positive "flyback" pulse of a magnitude L*(di/dt) at the collector of Q4 which is further transferred to transformer 210 by diode D14, and by Q5 which is still on due to the pulse P! which remains on for a period of time between 0.5–1.0 milliseconds beyond the duration of EST, as described. During this time, current has also been ramping up in the primary winding of transformer 210 but is interrupted temporarily by the described flyback pulse applied to the cathodes of diodes D13 and D14, reverse biasing (temporarily) D13 until the flyback pulse is transferred trough transformer 210 and into the transformer TK from the ground T1 through TN corresponding to the active engine cylinder (i.e. the transformer having a switch SWK currently being driven to a closed circuit (conductive) state. Current then resumes ramping the transformer 210 until the pulse SK drops to a low level. This described process repeats for successive EST pulses applied to the base of Q4.

The short pulse SK is applied to the gate of the active switch SWK just long enough to ensure the second flyback pulse is transferred from transformer 210 to the transformer TK that is associated with the cylinder to receive the combustion and measurement arcs. The transferred pulses are of alternative polarity as in the previously described embodiments of this invention. The remaining configuration and function of the circuitry of FIG. 6 is identical to that previously described for the circuits of FIG. 2 and of FIG. 5 and is not repeated.

The preferred embodiment for the purpose of explaining this invention is not to be taken as limiting or restricting the invention since many modifications may be made through the exercise of ordinary skill in the art without departing from the scope of the invention.

The embodiments of the invention in which a property or privilege is claimed are described as follows:

1. A self-diagnosing ignition control apparatus for driving sequential first and second drive signals across spaced electrodes of a spark plug in an engine cylinder to ignite an air/fuel mixture in the engine cylinder and to diagnose improper ignition of the air/fuel mixture, comprising:

a double strike ignition drive circuit having an ignition coil for delivering sequential first and second drive signals to the spark plug producing respective first and second arcs across the spark plug electrodes, the first arc for igniting the air/fuel mixture and the second arc for measuring a frequency band of energy trapped in the ignition coil;

a measurement circuit coupled to the ignition coil and having a network with a predetermined natural frequency, the network disposed between a terminal of the ignition coil and a ground reference, wherein the second drive signal includes a frequency component substantially at the predetermined natural frequency when improper ignition occurs and wherein the second drive signal does not include a frequency component at the predetermined natural frequency when proper ignition occurs; and the measurement circuit further comprising diagnostic circuitry for diagnosing the improper ignition by distinguishing excitation of the natural frequency of the network when a frequency component is present in the second drive signal substantially at the predetermined natural frequency.

2. The apparatus of claim 1, wherein the network comprises an inductor-capacitor network tuned to the predetermined natural frequency and including a parallel combination of an inductor and a capacitor.

3. The apparatus of claim 1, wherein the network comprises an inductor-resistor-capacitor network tuned to the predetermined natural frequency and including a capacitor coupled in parallel with a series combination of a resistor and inductor.

4. The apparatus of claim 1, further comprising:

a sensor for sensing a value of a predetermined engine parameter; and control circuitry for determining a time delay between the sequential first and second drive signals as a predetermined function of the sensed value.

5. The apparatus of claim 4, wherein the predetermined engine parameter is engine speed.

6. The apparatus of claim 1, wherein the measurement circuit further comprises:

a measurement circuit output terminal; and a rectifier coupled between the output terminal and the network for rectifying the network output into a unipolar signal provided at the output terminal.

7. The apparatus of claim 6, further comprising comparator circuitry for comparing the unipolar signal to a threshold signal magnitude and indicating improper ignition when the magnitude of the unipolar signal exceeds the threshold signal magnitude following the production of the second arc across the spark plug electrodes.

8. A self-diagnosing ignition control circuit for applying ignition drive signals to a spark plug with spaced electrodes in an internal combustion engine cylinder for igniting an air/fuel mixture in the engine cylinder, comprising:

an ignition drive circuit including an ignition coil with opposing upper and lower electrical terminals, the upper electrical terminal coupled to the spark plug for applying sequential first and second drive signals to the spark plug for generating first and second arcs across the spaced electrodes;

a misfire detection circuit having an input terminal, an output terminal and a network coupled between the input terminal and a ground reference, the input terminal coupled to the lower electrical terminal of the ignition coil, the network being tuned to a predetermined frequency; and the predetermined frequency selected as a frequency that is present in said drive signals at the lower electrical terminal in the absence of combustion in the engine cylinder and that is not present in said drive signals in the presence of combustion in the engine cylinder;

wherein presence of the predetermined frequency in the second drive signal excites frequency of the network, causing a signal perturbation at the output terminal of the misfire detection circuit indicating improper combustion of the air/fuel mixture.

9. The circuit of claim 8, further comprising:

a sensor for sensing a parameter indicating an engine operating condition; and control circuitry for generating a time delay between the sequential first and second drive signals as a predetermined function of the sensed parameter.

10. The circuit of claim 8, wherein the network further comprises:

an L-C network comprising a parallel combination of an inductance and a capacitance, the inductance and capacitance selected so the natural frequency of the L-C network corresponds to the predetermined frequency.

11. The circuit of claim 8, wherein the network further comprises:

an L-R-C network comprising a series combination of an electrical resistance and an electrical inductance, the series combination in parallel with an electrical capacitance, the electrical inductance, resistance, and capacitance being selected so the natural frequency of the L-R-C network corresponds to the predetermined frequency.

12. The circuit of claim 8, wherein the misfire detection circuit further comprises a rectifier element coupled between the network and the output terminal of the misfire detection circuit for rectifying the signal passed from the second terminal of the ignition coil through the network into a unipolar signal.

13. The circuit of claim 12, further comprising circuitry for comparing the unipolar signal at the output terminal of the misfire detection circuit to a predetermined signal threshold and for indicating improper combustion of the air/fuel mixture in the engine cylinder when the unipolar signal exceeds the predetermined signal threshold following application of the second drive signal to the spark plug.

14. The circuit of claim 8, for applying ignition drive signals to a plurality of spark plugs, each of the plurality having spaced electrodes and corresponding to an individual one of N engine cylinders for igniting an air/fuel mixture in the individual one of N engine cylinders, further comprising:

a plurality of transformers coupled to the upper electrical terminal of the ignition coil, each of the plurality of transformers assigned to an engine cylinder having an enable switch for enabling the corresponding transformer;

control circuitry for identifying an active cylinder and for driving the enable switch for the transformer assigned to the active cylinder to a predetermined state allowing for application of the first and second drive signals to be applied to the spark plug of the active cylinder across the transformer assigned thereto; and the plurality of transformers having an ignition coil with a lower electrical terminal, the lower electrical terminals of the plurality of transformers being coupled together and to the input terminal of the misfire detection circuit.

* * * * *